United States Patent [19]

Lloyd

[11] Patent Number: 4,836,759

[45] Date of Patent: Jun. 6, 1989

[54] ROTARY PUMP WITH ORBITING ROTOR OF HARDER MATERIAL THAN STATOR

[75] Inventor: Ian Lloyd, Wynnum West, Australia

[73] Assignee: Nautical Services Pty. Ltd., Queensland, Australia

[21] Appl. No.: 95,606

[22] PCT Filed: Nov. 10, 1986

[86] PCT No.: PCT/AU86/00342

§ 371 Date: Jul. 8, 1987

§ 102(e) Date: Jul. 8, 1987

[87] PCT Pub. No.: WO87/03047

PCT Pub. Date: May 21, 1987

[30] Foreign Application Priority Data

Nov. 8, 1985 [AU] Australia ..... PH3314

[51] Int. Cl.[4] ..... F04C 2/04; F04C 5/00; F04C 11/00; F04C 18/04

[52] U.S. Cl. ..... 418/56; 418/60; 418/66; 418/131; 418/153; 418/178

[58] Field of Search ..... 418/56, 60, 66, 131, 418/133, 100, 153, 178

[56] References Cited

U.S. PATENT DOCUMENTS

| | | | |
|---|---|---|---|
| 428,740 | 5/1890 | Almond | 418/66 |
| 1,628,888 | 5/1927 | Klinge | 418/66 |
| 1,876,370 | 9/1932 | Weber | 418/66 |
| 2,237,075 | 4/1941 | Kemper | 418/56 |
| 2,313,387 | 3/1943 | McArthur et al. | 418/100 |
| 2,578,798 | 12/1951 | Gordinier | 418/56 |
| 3,161,141 | 12/1964 | Refson | 418/56 |
| 3,265,003 | 8/1966 | Kaechele | 418/131 |
| 3,514,233 | 5/1970 | Braun | 418/56 |
| 3,978,665 | 9/1976 | Yoshioka | 418/60 |

FOREIGN PATENT DOCUMENTS

| | | | |
|---|---|---|---|
| 614727 | 12/1948 | United Kingdom | 418/56 |
| 905865 | 9/1962 | United Kingdom | 418/66 |

*Primary Examiner*—John J. Vrablik

*Attorney, Agent, or Firm*—Larson and Taylor

[57] ABSTRACT

A reversible, self-priming rotary pump has a housing with a stator of elastomeric material which is softer than the elastomeric material of the rotor on a cam on shaft. The inlet and exhaust ports are separated by a lobe received in a recess in the stator. As the shaft is rotated, the rotor orbits within the stator to pump the fluid between the inlet and exhaust ports, the stator being at least partially compressed along the line of contact with the rotor to form an efficient seal therebetween.

15 Claims, 3 Drawing Sheets

ROTARY PUMP WITH ORBITING ROTOR OF HARDER MATERIAL THAN STATOR

BACKGROUND OF THE INVENTION (1) Field of the Invention

This invention relates to rotary pumps.

(2) Prior Art

Rubber impeller pumps are commonly used in marine and other applications because of their self-priming ability. This type of pump is found in almost every type of vessel afloat and has been blamed for more engine seizures and failures caused through engine overheating than any other component. The problem with this type of pump is the high friction in the pump due to the impeller vanes' continuous hard contact with the housing and its compression by the cam. The impeller vanes compressed by the cam between the inlet and exhaust ports act as a valve. Damage is also caused by "engine rolling" when a diesel engine stops.

This is caused by compression bouncing the pistons in reverse on stopping, causing the impellor to be turned in reverse. When the engine is started, the impeller is turned in the original direction. When the impeller vanes are turned over during the reversal of direction at least some of the vanes are pinched between the cam and the housing which eventually results in failure of the vane. The broken vanes reduce the capacity of the pump, can damage or break other vanes and can enter the engine block and block the flow causing overheating.

When started dry, the friction can rapidly destroy the impeller and both the impeller and housing are damaged by sand or mud in the water being pumped.

Despite the widespread use of such pumps, their failures are well known.

SUMMARY OF THE PRESENT INVENTION

It is an object of the present invention to provide a rotary pump which is preferably self-priming.

It is a preferred object to provide a pump which is suitable for a wide range of applications and which can provide over a wide range of speeds with a low energy input required.

It is a further preferred object to provide a pump which is chemical resistant, which has a high volume output and where the output can be varied by changing only the cam and rotor.

It is a still further preferred object to provide such a pump which is suitable for high/speed high pressure applications, low speed/high volume applications and as an air compressor.

It is still further preferred object to provide a pump which will pump in either direction and will pump water, chemicals, viscous fluids, compressed air and hydraulic fluids.

Other preferred objects of the present invention will become apparent from the following description.

In a broad aspect the present invention resides in a rotary pump including:

a pump housing with a stator having an inlet port, and an exhaust port;

a rotor, within the stator mounted, on a shaft or a cam on the shaft, the shaft or cam being rotatably mounted in the housing; and a lobe on the rotor engageable in a recess within the stator to prevent rotation of the rotor, the lobe being intermediate the inlet and exhaust ports; the rotor and lobe being formed of, or coated with, an elastomeric material of different hardness to an elastomeric material forming, or lining, the stator so that the rotor and lobe, and/or the stator, are at least partially compressed as the rotor moves in an orbital path within the stator to form two pumping chambers of variable capacity.

Preferably the housing is formed of cast or extruded metal (e.g. aluminium) or moulded plastics material and the stator comprises a liner of elastomeric material of low Durometer hardness.

Preferably the shaft is mounted substantially co-axially in end plates in the housing and has an eccentric cam rotatably received in an eccentrically or concentrically located bore in the rotor. The rotor or lobe are preferably formed of an elastomeric material of higher Durometer hardness than the stator and the cam, which may be formed integrally with the shaft, is preferably formed of material of higher Durometer hardness than the rotor.

Preferably the lobe acts as a valve to control the flow of fluid through the ports.

BRIEF DESCRIPTION OF THE DRAWINGS

To enable the invention to be fully understood, a number of preferred embodiments will now be described with reference to the accompanying drawings, in which.

DETAILED DESCRIPTION OF THE PREFERRED EMBODIMENTS

Figure 1:
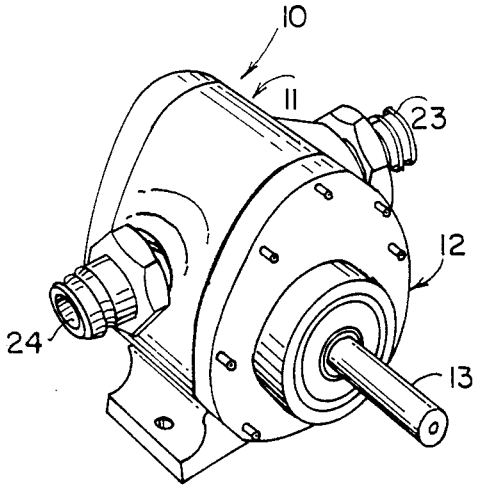
FIG. 1 is a perspective view of a first embodiment of the pump.
Figure 2:
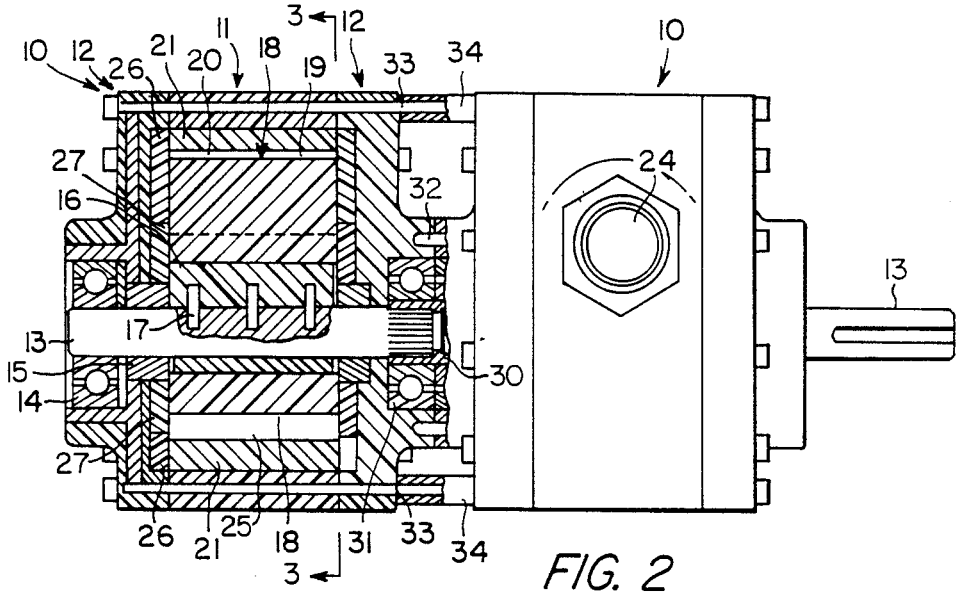
FIG. 2 is a part sectional view showing two of the pumps connected together.
Figure 3:
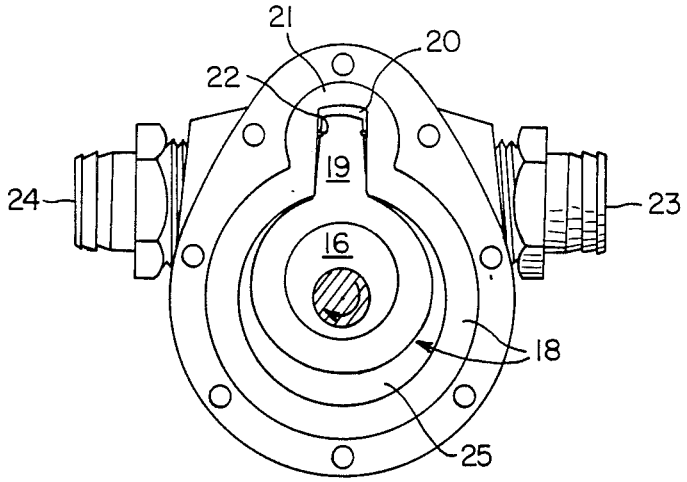
FIG. 3 is a sectional end view of one of the pumps taken on line 3—3 on FIG. 2.

Referring to FIGS. 1 to 3, the pump 10 has a housing 11 with removable end plate 12 secured by studs. The housing and end plates are formed of stainless steel reinforced mould plastics material.

A stainless steel shaft 13 is rotatably journalled in roller bearings 14 in the end plates 12, the shaft being sealed to the end plates by seals 15. An eccentric cam 16, of nylon material, and with a hardness of e.g. Durometer 63D or harder is moulded about the shaft 13 and is secured by radially extending pins 17.

Referring to FIG. 3, the rotor 18 is mounted on the cam 16, the cam being received in a concentric bore, and the rotor is formed e.g. of "Teflon" (trade mark) fibre reinforced polyurethane/polyester with a hardness of Durometer 60D.

A lobe 19 is formed integrally with the rotor 18 and the lobe 19 is received in a recess 20 in the stator 21 in the housing. The stator is formed by a liner in the housing, the liner being moulded of nitryl rubber, polyurethane or polyeter with a hardness of e.g. Durometer 94A or softer. The clearance between the lobe and the recess may be e.g. 1.5–3.0 mm and the lobe 19 has side seals 22 which contact the adjacent faces of the recess.

An inlet port 23 and an exhaust port 24 (see FIG. 5) are provided in the housing and are in communication with the variable volume pumping chambers 25, only one of which is shown in FIG. 3, formed by the rotor and the stator. The ports are kept separate by the sealing contact between the lobe and the recess walls.

Referring to FIG. 2, end inserts 26 are received in the end plates 12 in contact with the stator 21. Wear plate inserts 27, of harder "Teflon" elastomeric material, are received in the end inserts in contact with the rotor 18. As the rotor 18 is of harder material than the stator, the stator is sealably compressed along the line of contact between the rotor and stator and the lobe 19 and the sides of the recess 20 are also in sealable contact. As the rotor is orbited within the stator, fluid is drawn into the pump via the inlet port 23 and pushed around the stator in the pumping chambers 25 in the direction of rotation of the shaft, and the exhaust port 24.

The lobe 19 "rocks" within the recess 20 to act as a valve to control the flow of fluid into and out of the ports and to separate the ports at all times. The pressure in the pump pushes the lobe into contact with the side faces of the recess.

Clearance is provided between the rotor and wear plate inserts 27 to allow the fluid being pumped to act as a lubricant and coolant for the pump and the compression of the stator (or rotor) where the rotor rolls in contact with the stator gives an excellent seal between these components. (Because the elastomeric materials of the wear end plates and/or the rotor may absorb water and swell, the clearances therebetween may be reduced and the efficiency of the pump improved.

As shown in FIG. 2, two of the pumps 10 may be connected to a single drive. The inner end of each shaft 13 is splined to receive in coupling sleeve 30 journalled in larger roller bearings 31 than the bearings 14. The inner end plates 12 of the pumps are connected and aligned by dowel pins 32 and the pumps secured together by through bolts 33. Spacer bushes 34 are provided between the adjacent end plates 12.

The two pumps may be driven together to power e.g. separate eductors for a desalinator unit. However, in certain applications, it may be required to pump a single fluid with double the capacity of one of the pumps 10.

Figure 4:
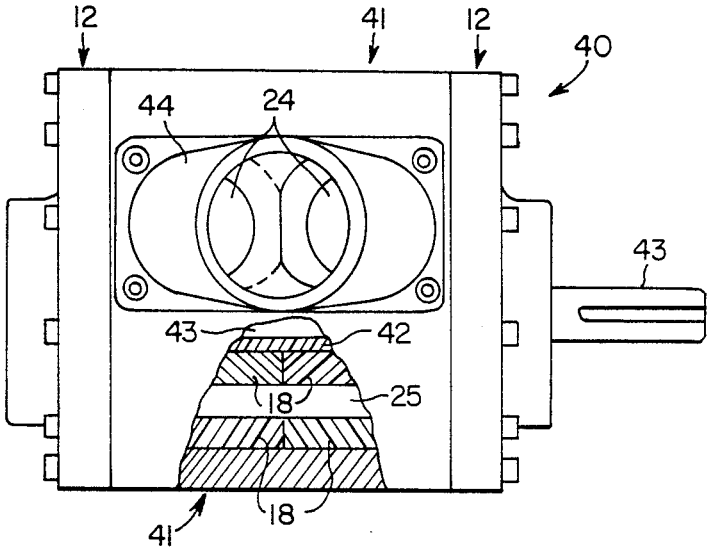
FIG. 4 is a part sectional view of a double-capacity pump according to a second embodiment of the pump.
Figure 5:
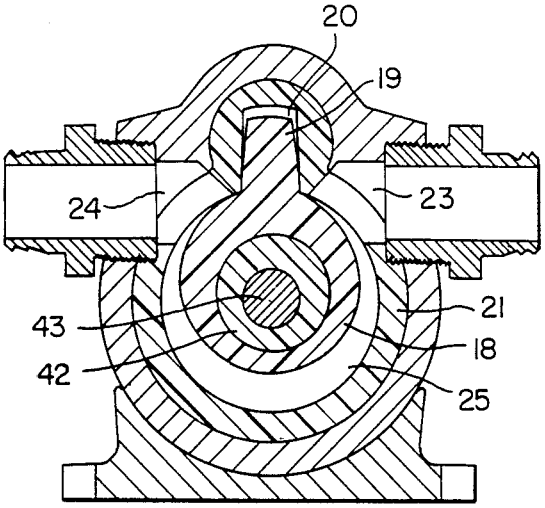
FIG. 5 is a sectional end view of the pump of FIG. 4.

Referring to FIGS. 4 and 5, the pump 40 has a housing 41 formed of extruded aluminium which is cut to length and closed by a pair of end plates 12. The housing is lined with a pair of stators 21. A pair of rotors 18 are provided within the stators, mounted on a one-piece cam 42 moulded onto the shaft 43 journalled in the bearings 14 (not shown) in the end plates.

Pairs of inlet and exhaust ports 23, 24 are provided in the housing and are connected by respective inlet and exhaust manifolds 44.

As the capacity can be doubled or trebled by increasing the length of the housing and providing a suitable shaft and cam assembly, and manifolds, only a minimum number of spare parts must be kept in inventory as the standard rotors, stators and end plates are used whatever the desired capacity.

In this embodiment, the rotor has an eccentric bore which receives the cam. This increases the throw on the rotor to incease the volume output of the pump.

Preferably the eccentric bore in the rotor is used in lower speed pumps, the concentric bore being used in the higher speed pumps.

As the metal housing 14 and the shaft 43 are fully lined and do not come into contact with the fluid being pumped, the pump can be used for reactive or corrosive chemicals such as acids and alkalis. Because of the compressive nature of the stator (and/or rotor), the pump can also pump fluids which may contain e.g. sand or dirt without any, or very little damage.

Figure 6:
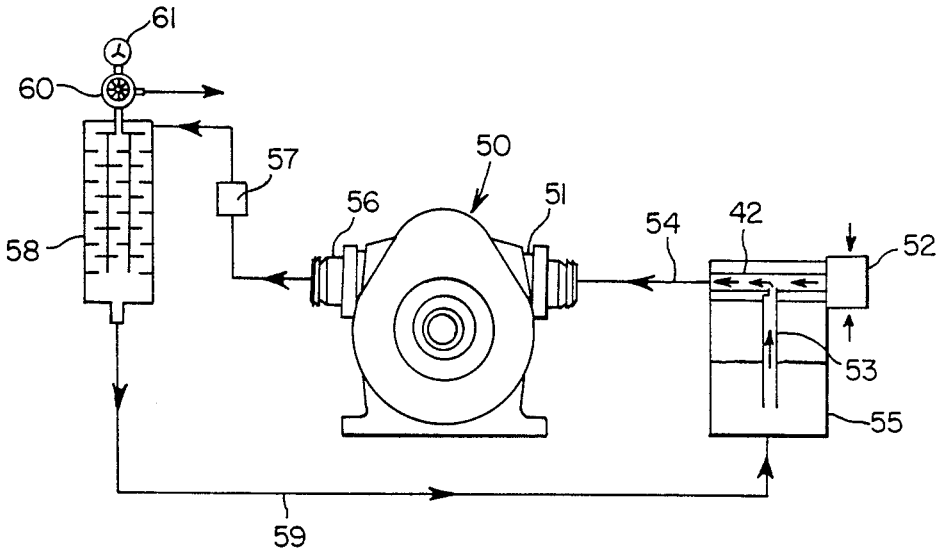
FIG. 6 is a schematic circuit of a third embodiment of the pump used on an air compressor unit.

FIG. 6 shows the pump used as an air compressor 50, where lubricant must be introduced to the air.

In this system, air is drawn into the inlet port 51 via a filter 52, and an eductor 53 in the inlet pipe 54 draws oil from a tank 55.

After compression in the pump 50, the compressed air/oil mixture passes through the outlet port 56 to a check valve 57 and then into an air/oil separator 58, where the oil is removed and drains back to the tank 55 via an oil return line 59. The compressed air is fed to an air tank (not shown) through a regulator 60 fitted with a pressure gauge 61.

The potential applications for the pump are only limited by the user's imagination and it can be used in high pressure/high speed applications e.g. in high pressure hydraulic systems, low speed/high volume applications, e.g. as a steering pump, as a pump for agricultural chemicals or salt water, or as an air compressor. The pump is simple, rugged, reversible and highly efficient.

Various changes and modifications may be made to the embodiments described without departing from the scope of the present invention defined in the appended claims.

I claim:

1. A rotary pump including:

a pump housing with a stator having an inlet port, and an exhaust port, said stator including an inner surface and an outer surface;

a rotor, mounted within and engaging the inner surface of the stator, and being mounted on a shaft, the shaft being rotatably mounted in the housing; and a lobe on the rotor engageable in a recess within the stator to prevent rotation of the rotor, the lobe being disposed intermediate the inlet and exhaust ports; at least the outer surface of the rotor and lobe comprising an elastomeric material of a first hardness and at least the inner surface of the stator comprising an elastomeric material of a second hardness different from said first hardness so that at least one of the rotor and lobe, and the stator, are at least partially compressed as the rotor moves in an orbital path within the stator to form two pumping chambers of variable capacity, said shaft being mounted substantially coaxially with the stator in end plates in the housing and having an eccentric cam rotatably received in an eccentrically located bore in the rotor.

2. A pump according to claim 1 wherein:

the stator comprises a liner, formed of elastomeric material with a low Durometer hardness within the housing; and the rotor and lobe are formed integrally of an elastomeric material of higher Durometer hardness than the stator.

3. A pump according to claim 1 wherein:

the cam is moulded of elastomeric material on the shaft.

4. A pump according to claim 1 wherein:

inserts in the end plates sealably engage the ends of the stator and the rotor.

5. A pump according to claim 1 wherein:

the lobe separates the inlet and exhaust ports to prevent direct flow therebetween.

6. A pump according to claim 1 wherein said rotor is mounted on said shaft by means of a cam on the shaft, said cam being formed of nylon.

7. A pump according to claim 1 wherein said rotor is mounted on said shaft by means of a cam on the shaft, said cam being formed of stainless steel.

8. A pump according to claim 1 wherein:

the stator is formed of an elastomer selected from the group consisting of nitryl rubber, polyurethane and polyester;

the rotor and lobe are formed of an elastomer selected from the group consisting of nitryl rubber, polyurethane, polyester and a polyurethane/polyester mixture with fiber reinforcement; and the shaft is formed of stainless steel.

9. a pump according to claim 8 wherein said shaft is mounted in end plates in the housing and said end plates are formed of stainless steel reinforced plastics material.

10. A pump according to claim 9 wherein said housing is formed of extruded aluminum.

11. A pump according to claim 9 wherein said housing is formed of stainless steel reinforced plastics material.

12. A rotary pump as claimed in claim 1 wherein said rotor is mounted on said shaft by means of a cam on the shaft.

13. A rotary pump as claimed in claim 12 wherein said cam is formed integrally with the shaft.

14. A rotary pump of double capacity including:

a pump housing with a stator having an inlet port, and an exhaust port, said stator including an inner surface and an outer surface;

a rotor, mounted within and engaging the inner surface of the stator, and being mounted on a shaft, the shaft being rotatably mounted in the housing; and a lobe on the rotor engageable in a recess within the stator to prevent rotation of the rotor, the lobe being disposed intermediate the inlet and exhaust ports; at least the outer surface of the rotor and lobe comprising an elastomeric material of a first hardness and at least the inner surface of the stator comprising an elastomeric material of a second hardness different from said first hardness so that at least one of the rotor and lobe, and the stator, are at least partially compressed as the rotor moves in an orbital path within the stator to form two pumping chambers of variable capacity, two said stators being fitted within the housing, and said housing being of twice the length of a single capacity pump; and two said rotors being fitted on a single cam on the shaft.

15. A pump according to claim 14 wherein:

a respective inlet port and exhaust port is provided for each stator, and the respective inlet and exhaust ports are connected by respective manifolds.

* * * * *